US005442599A

United States Patent [19]

Burke et al.

[11] Patent Number: 5,442,599

[45] Date of Patent: Aug. 15, 1995

[54] IMPULSE CLOCK SYSTEM

[75] Inventors: Michael P. Burke, Dearborn; Stephen A. Bogdan, Huntington Woods; Bruce D. Emaus, Dearborn Heights, all of Mich.

[73] Assignee: National Time & Signal Corporation, Oak Park, Mich.

[21] Appl. No.: 274,485

[22] Filed: Jul. 13, 1994

Related U.S. Application Data

[63] Continuation-in-part of Ser. No. 186,654, Jan. 25, 1994, abandoned, which is a continuation of Ser. No. 589,174, Sep. 27, 1990, Pat. No. 5,282,180.

[51] Int. Cl.[6] ..... G04C 11/00; G04C 13/04

[52] U.S. Cl. ..... 368/46; 368/52; 368/59; 368/187

[58] Field of Search ..... 368/26, 80, 46–61, 368/185–187

[56] References Cited

U.S. PATENT DOCUMENTS

| | | | |
|---|---|---|---|
| 3,011,078 | 11/1961 | Reynolds, Jr. . | |
| 3,137,121 | 6/1964 | Tringali . | |
| 3,469,390 | 9/1969 | Zimmer | 368/185 |
| 3,490,225 | 1/1970 | Duris et al. | 368/185 |
| 3,732,685 | 5/1973 | Haydon | 368/185 |
| 3,739,568 | 6/1973 | Van Haaften . | |
| 3,889,461 | 6/1975 | Marti et al. . | |
| 3,902,311 | 9/1975 | Chacon et al. . | |

*Primary Examiner*—Vit W. Miska

*Attorney, Agent, or Firm*—Young, MacFarlane & Wood

[57] ABSTRACT

A master secondary clock system of the analog impulse type consisting of separate motor driven secondary clocks and a master control unit. The secondary clocks can be set at any time by an appropriate signal from the master clock so that even widely scattered secondary clocks can be brought at any time to the correct time. In one disclosed embodiment, the secondary clocks are moved by a series of rapid pulses form the master clock to a predetermined known time, the secondary clocks are brought into registry, the master clock calculates the time disparity between the registration time and the real time, and the secondary clocks are moved in unison to the real time. In another disclosed embodiment in which each secondary clock includes a microprocessor, an encoded digital signal representing the real time is transmitted to the secondary clocks, the secondary clocks move to a predetermined known time, a microprocessor in each secondary clock calculates the time disparity between the known time and the real time upon arrival of the second clock at the known time, and the secondary clocks thereafter move to the real time.

15 Claims, 7 Drawing Sheets

10
12
14
16
18
18a
18b
18c
20
20a
20b
20c
22
24
30
32
34
36
40
42
42a
44
46
48
48a
48b
50
50a
112

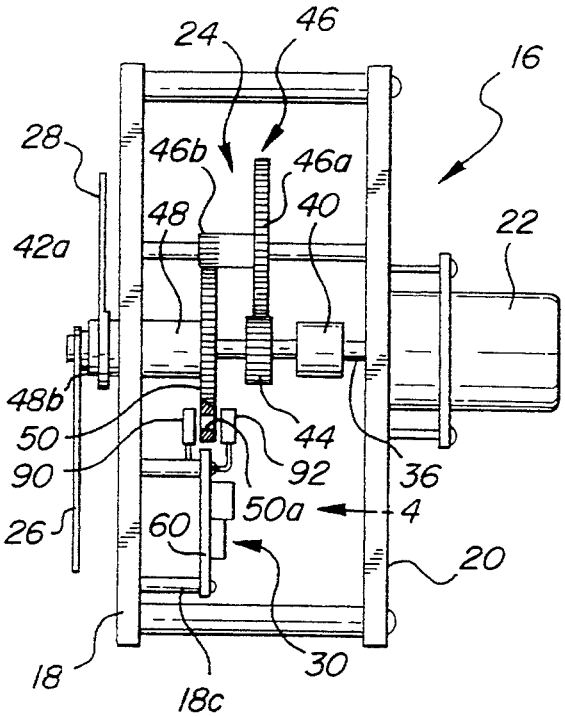
FIG-3
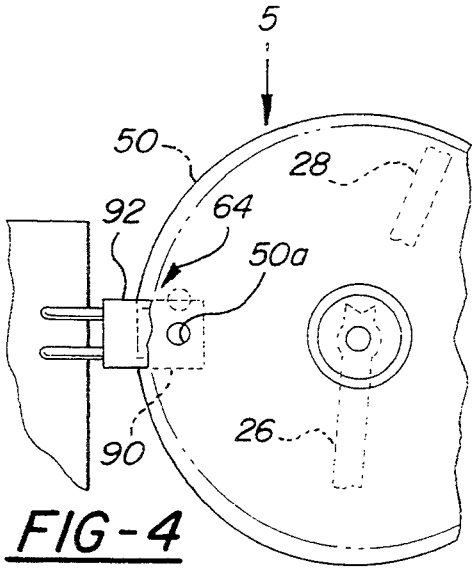
FIG-4
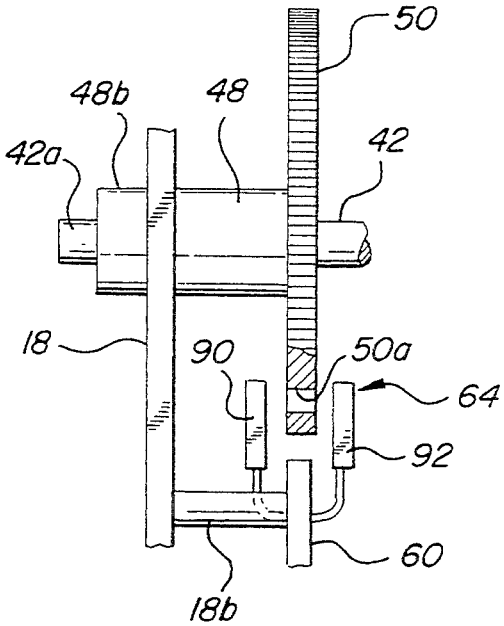
FIG-5
FIG-8
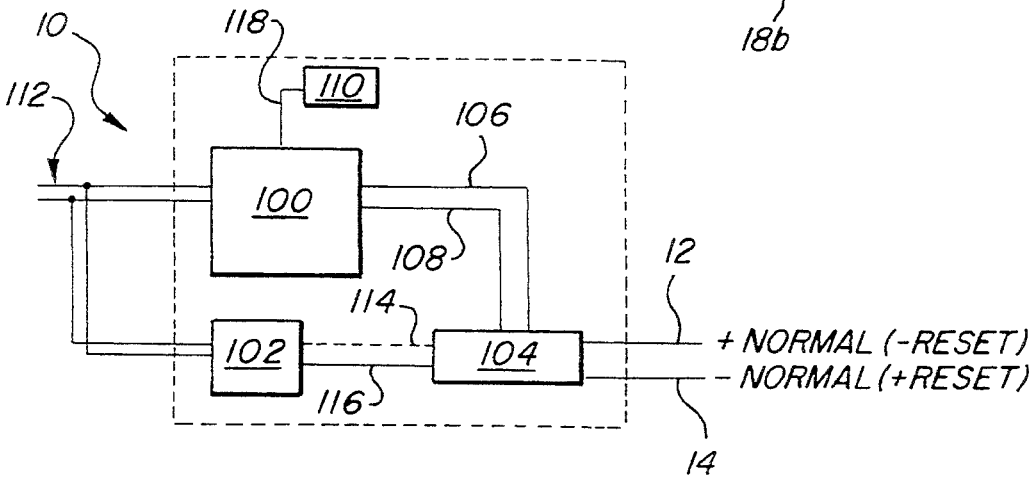

FIG-12
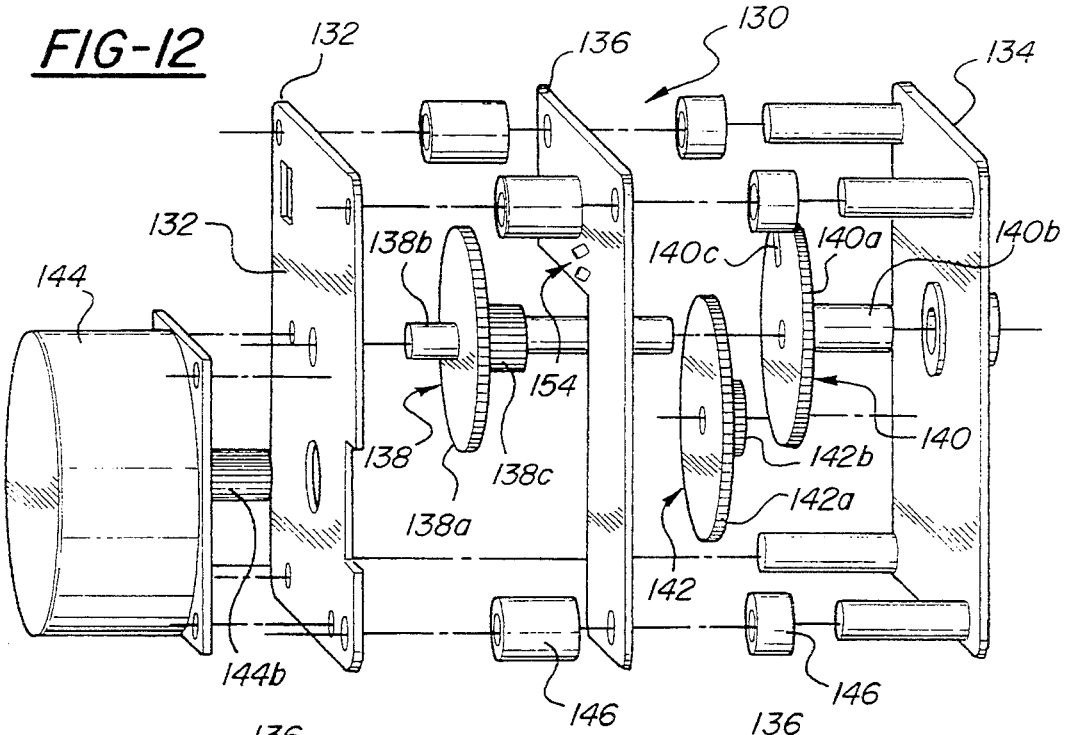
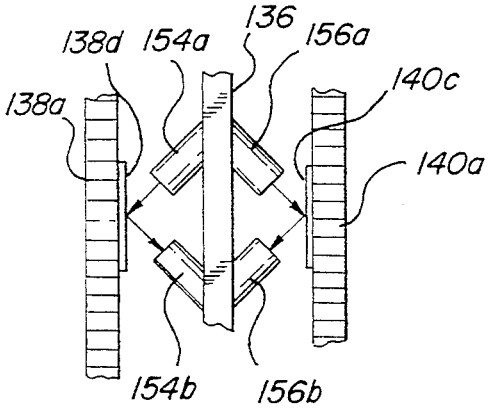
FIG-18
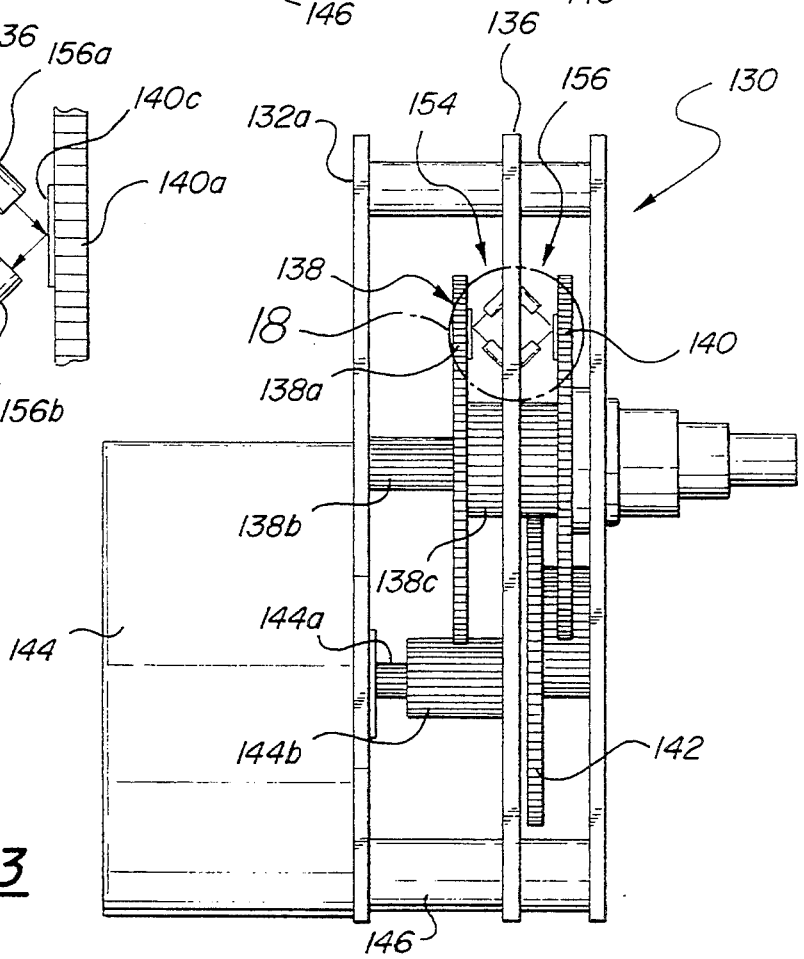
FIG-13

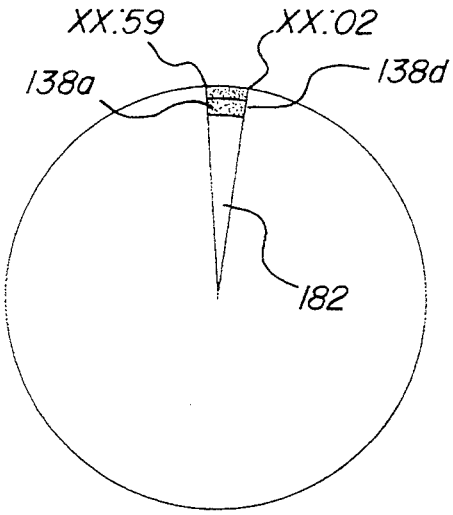
FIG-14
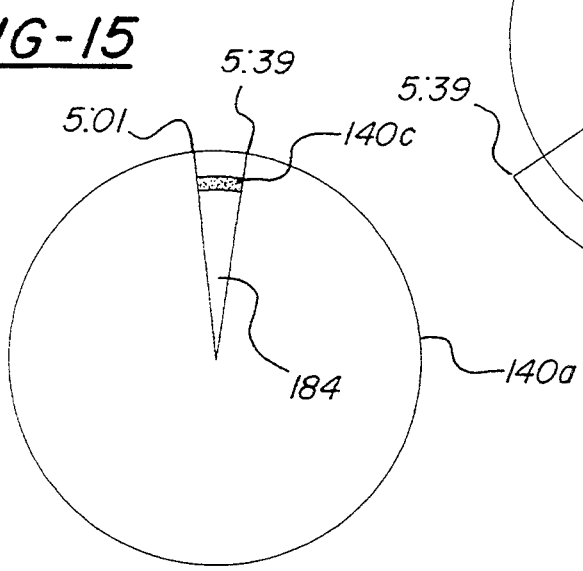
FIG-15
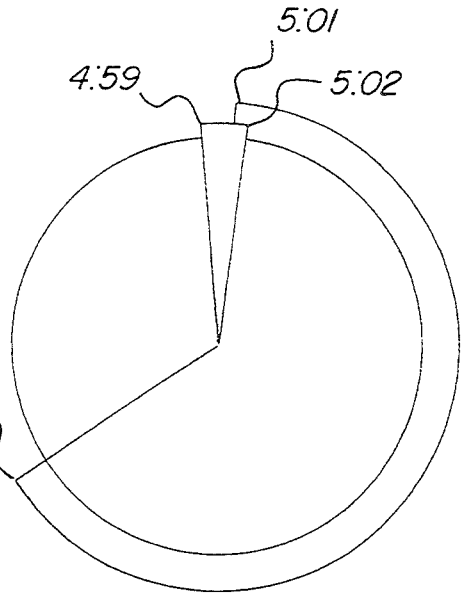
FIG-16
FIG-17
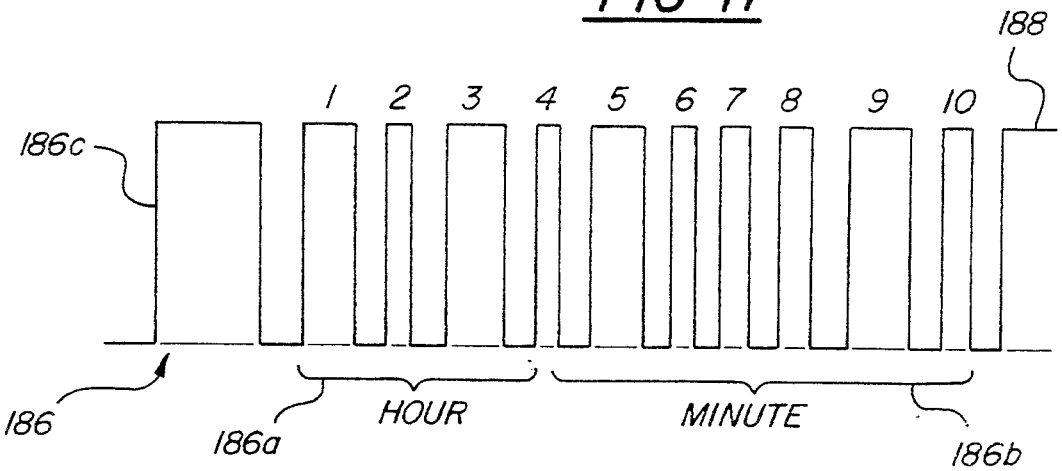

IMPULSE CLOCK SYSTEM

RELATED APPLICATION

This application is a continuation-in-part of U.S. patent application Ser. No. 08/186,654, filed on Jan. 25, 1994, now abandoned, which is a continuation of U.S. Ser. No. 07/589,174, filed on Sep. 27, 1990 and is now U.S. Pat. No. 5,282,180.

BACKGROUND OF THE INVENTION

This invention relates to clock systems and more particularly to analog clock systems of the type including a master clock or control and a plurality of secondary clocks controlled by the master. Master and slave systems of the analog type were originally impulse type systems in which the secondary clocks were slaves to the master control unit in the sense that they received pulses from the master every minute or other time increment to advance in normal operation. These systems were of pneumatic design including a pressure bellows and interconnecting pneumatic tubing with air pulses being employed to advance the secondary clocks. While these pneumatic type impulse clocks were generally satisfactory, they required considerable maintenance primarily relating to servicing leaks in the system.

In an effort to avoid these maintenance problems, impulse type systems were developed utilizing electric solenoid driven rachet mechanisms. These solenoid systems improve the reliability of the clock systems but have the disadvantage that they are correctable only to the hour so that if the secondary clocks become scattered throughout the system, they have to be manually reset to the proper hour. Solenoid systems with their ratchet mechanisms are also relatively slow and, for example, cannot exceed a pulse rate greater than 60 per minute without risking mechanical failure.

In an effort to overcome the disadvantages of the solenoid type impulse systems, synchronous motor systems were developed in which each secondary clock includes its own synchronous motor driving the clock mechanism so that the secondary clocks operate independently of the master clock and the master clock functions only to provide correction pulses in the event of a power outage or a mechanical failure. These synchronous systems have the advantage that they make available a sweep second hand frequently utilized by the educational market and they make possible the individual correction of secondary clocks more than one hour out of time. However, these synchronous systems, because they require each of the synchronous motors driving the individual synchronous clocks to run continuously, consume a rather large amount of power. They are also relatively complicated in terms of mechanical design, their speed of reset is rather slow, and they are unable to move directly to the correct hour and minute during correction.

SUMMARY OF THE INVENTION

This invention is directed at the provision of a improved resettable impulse clock system.

More specifically, this invention is directed to the provision of an impulse clock system which is extremely simple in construction and operation and extremely durable.

This invention is further directed to the provision of an impulse clock system which provides ready and rapid resetting of the secondary clocks.

The clock system of the invention includes a plurality of analog secondary clocks each including an incremental motor means to incrementally advance the respective clock, and control means which are operative to maintain real time, generate real time pulses for transmittal to the incremental motor means of the secondary clocks to incrementally advance the secondary clocks, and move the secondary clocks at any time to the real time as determined by the control means. This arrangement allows ready and rapid resetting of the secondary clock at any time.

According to a further feature of the invention, the control means further includes means operative to move the secondary clocks at a fast speed to a known time and means operative upon the arrival of the clocks at the known time to calculate the differential between the known time and the real time and thereafter move the clocks to the real time. This specific arrangement provides a simple and effective means of moving all the secondary clocks to the real time as determined by the control means.

According to a further feature of the invention, the control means includes a master clock operative to maintain real time and generate real time pulses for transmittal to the incremental motor means of the secondary clocks and means at each secondary clock operative to sense the arrival of the clock at the known time. With this arrangement the arrival of each clock at the known time may be sensed whereupon the differential between the known time and the real time may be calculated whereafter the clock may be moved to the real time as determined by the master clock.

In one embodiment of the invention, the master clock is further operative to generate a fast forward signal at any time to move the secondary clocks at a fast forward speed to the known time, is operative upon the arrival of the secondary clocks at the known time to calculate the disparity between the known time and the real time, and is operative to thereafter move the secondary clocks to the real time at a fast forward speed.

In another embodiment of the invention, the master clock is further operative to generate encoded digital signals representing the real time as maintained by the master clock; each secondary clock includes a processing circuit; and the processing circuit at each secondary clock is operative in response to receipt of an encoded digital signal from the master clock and in coaction with the master clock to move the associated secondary clock at a fast speed to the known time, thereafter calculate the disparity between the known time and the real time as represented by the encoded digital signal received by the processing circuit, and thereafter move the associated secondary clock at a fast speed to the real time.

BRIEF DESCRIPTION OF THE DRAWINGS

FIG. 3 is a top view of the secondary clock of FIG. 2;

FIG. 4 is a detailed view looking in the direction of the arrow 4 in FIG. 3;

FIG. 5 is a detailed view looking in the direction of the arrow 5 in FIG. 4;

FIG. 8 is a diagrammatic view of the master control unit of the invention clock system;

FIG. 12 is an exploded perspective view of a secondary clock assembly;

FIG. 13 is an assembly view of a secondary clock assembly;

FIG. 14 is a schematic view of a secondary clock showing the operation of the one hour sensor window;

FIG. 15 is a schematic view of a secondary clock showing the operation of the 12-hour sensor window;

FIG. 16 is a schematic view of a secondary clock showing the combined operation of the sensor windows;

FIG. 17 is a graphic representation of a time data transmission from the master clock to a secondary clock; and FIG. 18 is a detail view taken within the circle 18 of FIG. 13.

DETAILED DESCRIPTION OF THE PREFERRED EMBODIMENTS

Figures 1, 2:
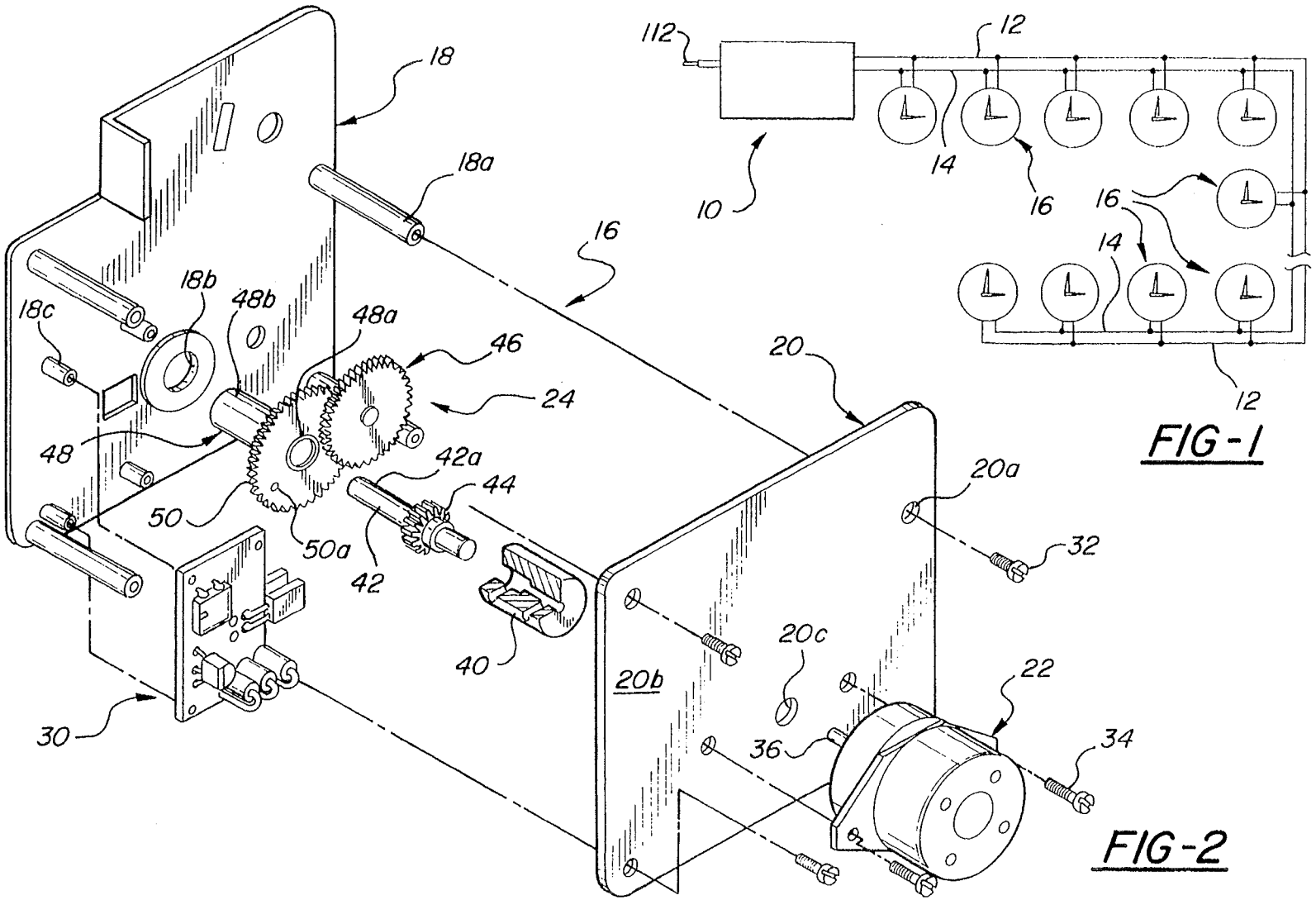
FIG. 1 is a diagrammatic view of a master and secondary clock system according to a first embodiment of the invention.
FIG. 2 is an exploded perspective view of one of the secondary clocks employed in the clock system of FIG. 1.
Figure 6:
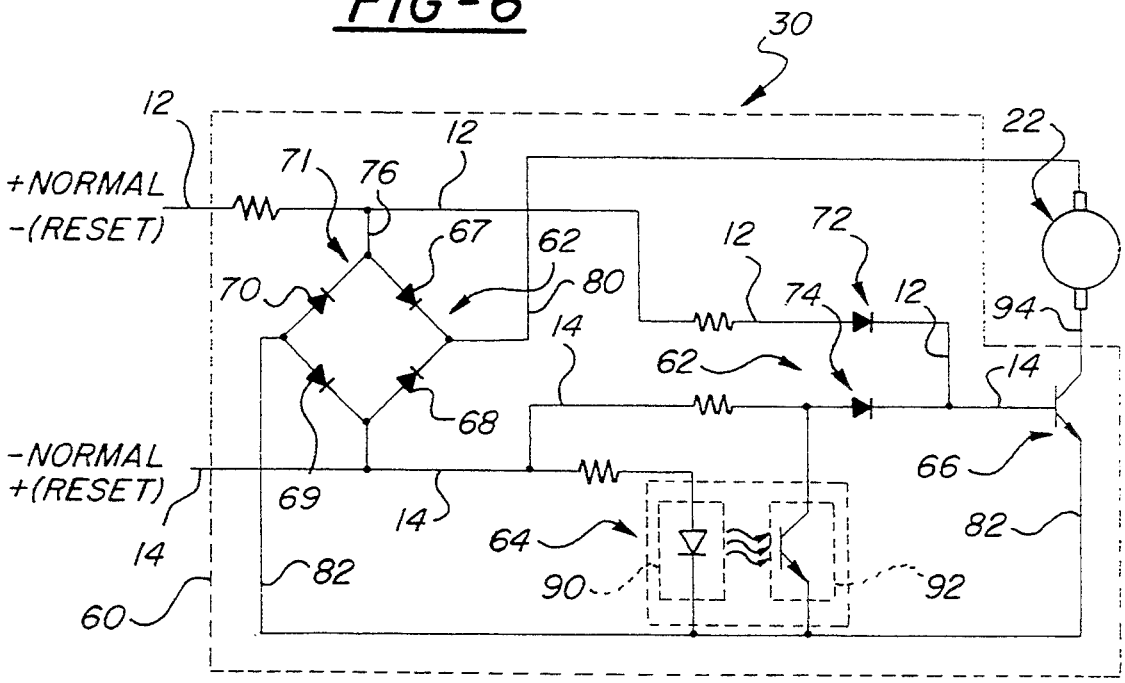
FIG. 6 is a circuit diagram of a motor control assembly employed in each secondary clock.
Figure 7:
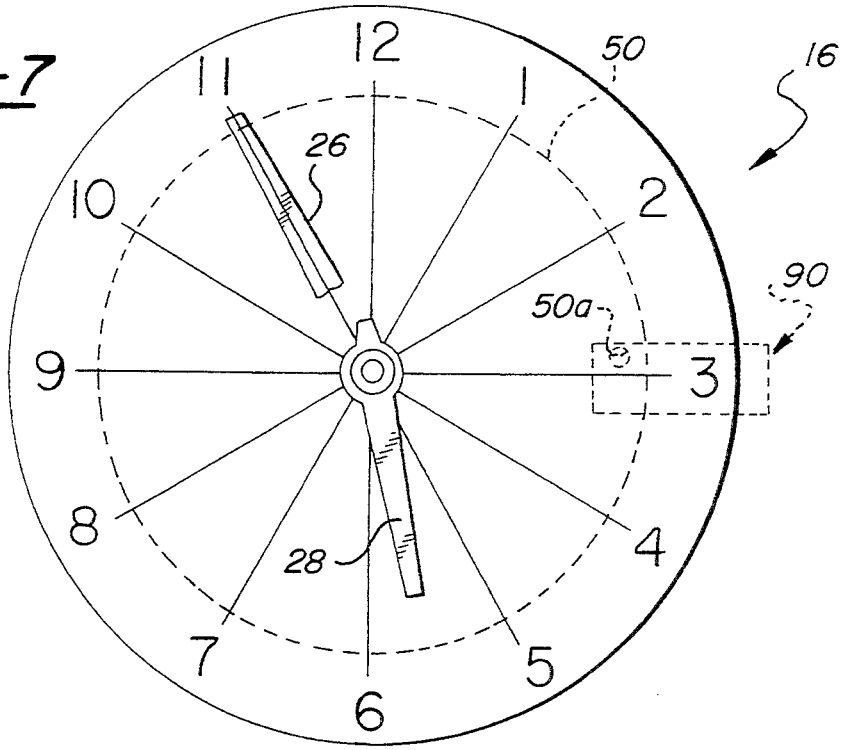
FIG. 7 is a view of the face of a secondary clock.

The invention clock system of the embodiment of FIGS. 1–8 includes a master control unit 10, electrical wires or leads 12 and 14, and a plurality of secondary clocks 16 respectively connected in parallel to leads 12 and 14.

Each secondary clock 16 includes a base plate 18, a back plate 20, a motor 22, a drive train 24, a minute hand 26, an hour hand 28, and a motor control assembly 30.

Plates 18 and 20 are maintained in spaced relation by a plurality of spacers 18*a* carried by base plate 18 and including internally threaded end portions coacting with screws 32 passing through apertures 20*a* in back plate 20 for engagement with the threaded end portions of the spacers 18*a*.

Motor 22 is a single phase stepper motor and is mounted to the rear face 20*b* of back plate 20 by screws 34 with the output shaft 36 of the motor passing through an aperture 20*c* in the back plate 20. Motor 22 is preferably a 24 VDC, 2 wire, six degrees stepper motor of the type available for example from Haydon Switch and Instrument Inc. of Waterbury, Conn. as Part No. A31306. Drive train 24 includes a union 40 coupled at one end thereof to the free end of motor output shaft 36; a minute hand shaft 42 coupled at one end thereof to the other end of union 40; a spur gear 44 mounted on shaft 42; an intermediate gear 46 including a large diameter portion 46*a* meshing with spur gear 44 and a reduced diameter portion 46*b*; a tubular hour hand shaft 48 journaled in an aperture 18*b* in base plate 18 and centrally passing and journaling minute hand shaft 42; and a gear 50 mounted on the rear end 48*a* of shaft 48 and meshing with reduced diameter gear portion 46*b* of intermediate gear 46.

Minute hand 26 is suitably secured to the distal or free end 42*a* of shaft 42 and hour hand 28 is suitably secured to the free or distal end 48*b* of tubular shaft 48. Drive train 24 will be seen to place the minute hand 26 in direct one to one driving relation to the output shaft 36 of the motor and to place the hour hand 28 in a 12 to 1 ratio with respect to the output shaft of the motor so that the minute hand, in known clock fashion, moves at a rate 12 times the rate of the hour hand.

Motor control assembly 30 includes a printed circuit board 60, a polarity sensitive diode network 62, a sensor assembly 64, and a transistor 66.

Circuit board 60 is of known form and may be positioned, for example, between back plate 20 and base plate 18 by a series of spacers 18*c* carried by base plate 18.

Polarity sensitive diode network 62 includes four diodes 67, 68, 69, 70 arranged in a bridge 71, a diode 72 in line 12, and a diode 74 in line 14. A lead 76 connects lead 12 to bridge 71; a lead 78 connects bridge 71 to lead 14; a lead 80 connects bridge 71 to the positive terminal of motor 22; and a lead 82 connects bridge 71 to transistor 66.

Sensor assembly 64 includes an emitter 90 and a detector transistor 92. Emitter 90 and detector 92 are connected in parallel relation between lead 14 and lead 82.

The three electrodes of transistor 66 are connected respectively to lead 14, lead 82, and a lead 94 connected to the negative terminal of motor 22.

With circuit board 60 positioned on spacers 18*c*, emitter 90 and detector 92 are positioned on opposite sides of the peripheral edge portion of gear 50 so that a window or aperture 50*a* in the peripheral edge portion of gear 50 will pass between the emitter 90 and detector 92 once for every revolution of gear 50 or once every 12 hours.

Master control unit 10 includes a master clock 100, a DC power supply 102, a polarity changer 104, a normal control line 106, a reset control line 108, and a battery 110.

Master clock 100 is computer based and is connected to a suitable 120 VAC source 112. The master clock tasks include time keeping, performing all calculations necessary to incrementally advance the secondary clocks to the exact time, transmitting all pulses on emitter normal line 106 or reset line 108, and interfacing with the user when programming automatic functions such as daylight savings and automatic actuation of peripheral devices such as bells, horns, chimes, lights, etc.

Dc power supply 102 is also connected to 120 VAC source 112 and serves to convert the 120 VAC source to 24 VDC for delivery over lines 114 and 116 to polarity changer 104.

Polarity changer 104 is connected between lines 114, 116 from DC power supply 102; lines 106, 108 from master clock 110; and leads 12, 14 connected to the secondary clocks.

Battery 110 is a back-up power source and is connected by a lead 118 to master clock 100. Battery 110 is provided in the event of a power failure so that the master clock 100 can keep time without the AC power. Instead of a battery, a receiver tuned to WWV or equivalent might be utilized.

It will be understood that the master control unit is the only time keeping component of the system and controls the time on all of the secondary clocks. The master unit keeps time by counting the cycles of the 120 VAC 60 Hz power supplied by the local power company. The master unit can also be adapted to use a 50 Hz supply. Other methods of time keeping can include receiving WWV, GPS or similar transmissions, modem connection with Bureau of Standards, or various oscillating crystal configurations. The master unit then transmits direct current pulses of voltages dependent upon the stepper motor selection, in this example 24 VDC. These pulses simultaneously advance each secondary clock in the system one increment.

Specifically, during normal or real time operation, master clock 110 pulses normal line 108 which instructs the polarity changer 104 to send pulses over lines 12,14 with line 12 positive and line 14 negative once each minute for a duration of one second. These normal or real time pulses are received by the respective stepper motors 22 of the secondary clocks 16 and are operative to incrementally advance the respective clocks with half of the incremental advance occurring on the rising edge of the pulse and the remaining half of the incremental advance occurring when the pulse is terminated. As previously noted, the pulses are 24 VDC and the motor steps six degrees during each incremental advance so that each incremental advance moves the minute hand forward one minute.

The clocks are advanced in this fashion until the system approaches one of two predetermined known or registration times, for example, 6 a.m. and 6 p.m. At a chosen time immediately prior to a registration time, for example 5:55, the master clock pulses the reset line 106 instead of the normal line 108 to make line 14 positive and line 12 negative. This reverse polarity pulse has the effect of enabling or activating the sensor assembly 64 in each secondary clock and, specifically, the reverse polarity pulse will turn on the detector transistor 92 and in turn off the transistor 66, and thereby the motor 22, at such time as the activated or energized detector transistor 92 receives an emission signal from emitter 90. The master clock thereafter proceeds to transmit reset or reverse polarity pulses to the secondary clocks at one minute intervals until the predetermined registration time of 6:00. This has the effect of correcting the time of any secondary clocks that are running 5 or less minutes fast as compared to the master time as kept by the master clock.

Specifically, if a secondary clock is running 5 minutes fast at the time that the reset pulses begin, the window 50*a* of the gear 50 of that clock will already be positioned between the emitter and detector of the sensor assembly of that clock at the time that the first reset pulse is transmitted by the master clock so that the transistor 66 of that clock will be immediately turned off to halt any further forward movement of that clock. For a clock running four minutes fast as compared to the time of the master clock at the time that the reset or reverse polarity signals are initiated, this clock will respond to the first reset pulse and move forwardly through a one minute increment but will not respond to any of the subsequent reset pulses since the first increment of reset movement will move the window 50*a* of the gear 50 of that clock into alignment with the associated emitter 90 and detector 92 to turn off transistor 66 and thereby motor 22. For a clock running three minutes fast at reset time, this clock will respond to the first two reset pulses transmitted by the master clock but will not respond to any subsequent pulses since the second pulse will have the effect of moving the window 50*a* of its gear 50 into alignment with its emitter 90 and detector 92. A clock running two minutes fast will be halted after receipt of three reset pulses and a clock running one minute fast will be halted after receipt of four reset pulses.

It will be seen that this five minute reset period has the effect of correcting the time of all clocks running between one and five minutes fast with respect to the time kept by the master clock. When the master clock reaches the registration time of 6:00 o'clock, the master clock sends out a long train of rapid pulses on the reset line. For example, pulses 20 milliseconds long may be transmitted every 40 milliseconds for 28.8 seconds for a total of 720 pulses. This string of pulses will provide enough pulses to correct any scattered secondary clock to 6:00. Clocks which are already on time will not be effected by these rapid pulses. The effect of this long train of rapid pulses will be to correct the time of any clocks that were more than five minutes fast at the time of the initiation of the reset operation as well as clocks that were slow at that time as compared to the time kept by the master clock. The described system has the advantage of moving the vast majority of secondary clocks only a small correction amount since the vast majority of clocks will be only a few minutes fast, and will therefore be corrected in the initial five minute reset phase, or will be only a few minutes slow, and will be quickly corrected by the first few pulses of the rapid string of pulses emitted by the master clock at 6:00. For those few clocks which may be more than five minutes fast and which will therefore not be corrected by the initial five minute reset phase, these clocks will be moved a sufficient amount by the 720 pulses emitted by the master clock at 6:00 so as to bring them to the correct time of 6:00.

The long train of pulses will be completed at exactly 28.8 seconds after 6:00 o'clock. At exactly one minute after 6:00, the master clock will again transmit a real time or normal pulse on line 108 to polarity changer 104 which will result in a normal pulse (12 positive and 14 negative) being transmitted to each secondary clock so that the clocks may resume their real time one minute incremental advances.

It will be appreciated that the motor control assembly 30 functions in two manners. The first function is to stop the clock from advancing past the registration time while in the reset mode. The motor control assembly's second function is to keep the polarity of the dc voltage the same at the motor poles regardless of the polarity sent from the polarity changer. The sensor assembly 64 is only energized when line 14 is positive and line 12 is negative, as is the case during the reset mode. During the normal time keeping mode, the sensor assembly is deenergized and the normal polarity, real time pulses from the master control unit (12 positive and 14 negative) will be sent directly to the motor. Since the sensor assembly is only enabled or activated during reset or reverse polarity mode, the normal time pulses will always be able to advance the motor past the registration time of 6:00 o'clock.

Upon any power interruption, the secondary clocks will stop and display the time of the interruption. The master clock 110, utilizing power from the back-up battery 110, records the time of the last pulse and keeps time itself using internal circuitry since the AC line is unavailable. When power resumes, the master clock calculates the time that has passed since the power interruption and then sends out the number of normal polarity pulses, in quick succession and utilizing normal line 100, required to advance all of the clocks to the exact time. Normal time keeping then resumes. As with the reset mode, these normal polarity pulses will be transmitted as pulses 20 milliseconds long every 40 milliseconds so that, for example, to correct for a one hour outage, 60 pulses lasting a total of 2.4 seconds will be required.

Further, at any point in time during the day, independent of registration times, if there exists a disparity between the displayed time on the master clock and at least one secondary clock, the master clock is able to correct all the secondary clocks to the exact time. This time correcting can be initiated, for example, by user intervention at the master clock such as by depression of a button 114. Although the time disparity between the master clock and at least one secondary clock is unknown to the master clock, all of the secondary clocks will be synchronized by rapidly advancing all of the secondary clocks to their registration time. This is accomplished by transmitting the conditioning signal to activate the secondary clock sensors along with a series of fast forward pulses to rapidly advance the secondary clocks. This will cause all of the secondary clocks to advance to the registration time and stop, in the manner previously described. As soon as all of the secondary clocks have been brought into registration at the registration time, the master clock will be able to calculate the disparity between the known registration time and the real time displayed by the master clock and transmit a series of fast forward pulses to rapidly advance all of the secondary clocks to the real time.

Changing or correcting the master time at the master clock at any time also results in the master clock calculating the difference between the initial time and the new or corrected time and then advancing all clocks to the exact minute. These correctional pulses may also be transmitted as pulses 20 milliseconds long every 40 milliseconds so that any correction of the secondary clocks to match the changed time at the master clock may be effected in a matter of seconds.

Figure 9:
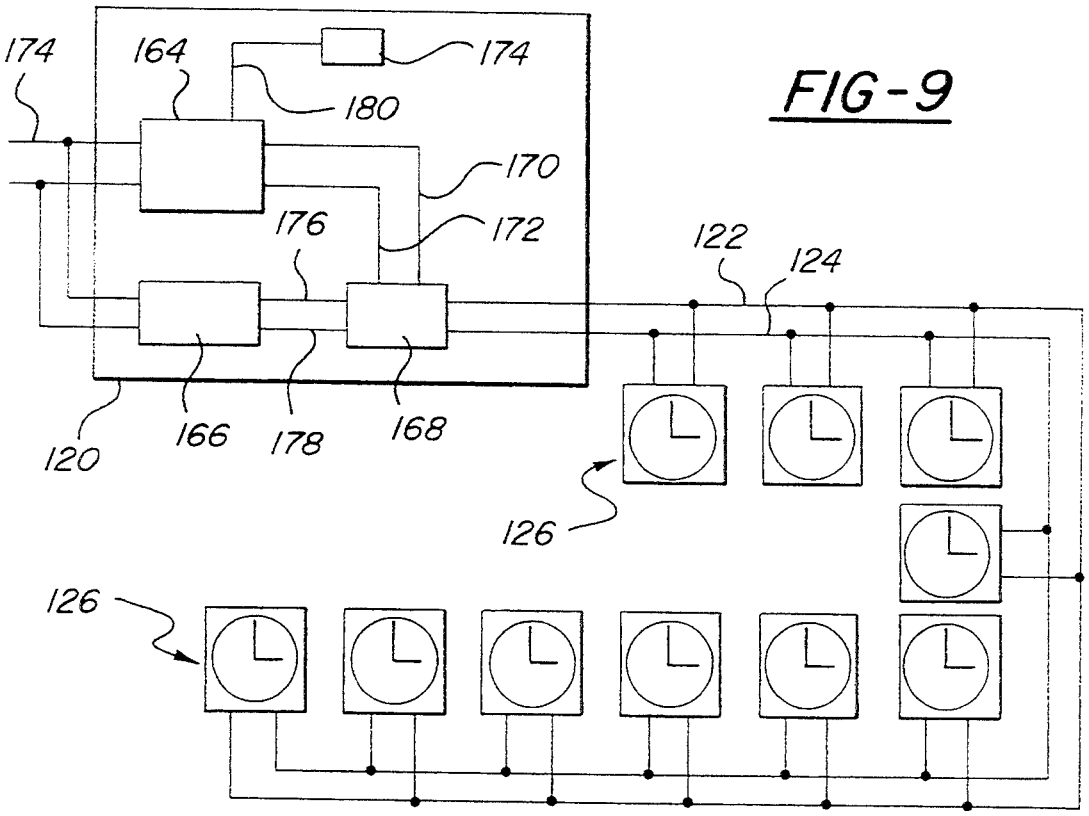
FIG. 9 is a diagrammatic view of a master and secondary clock system according to a second embodiment of the invention.
Figure 10:
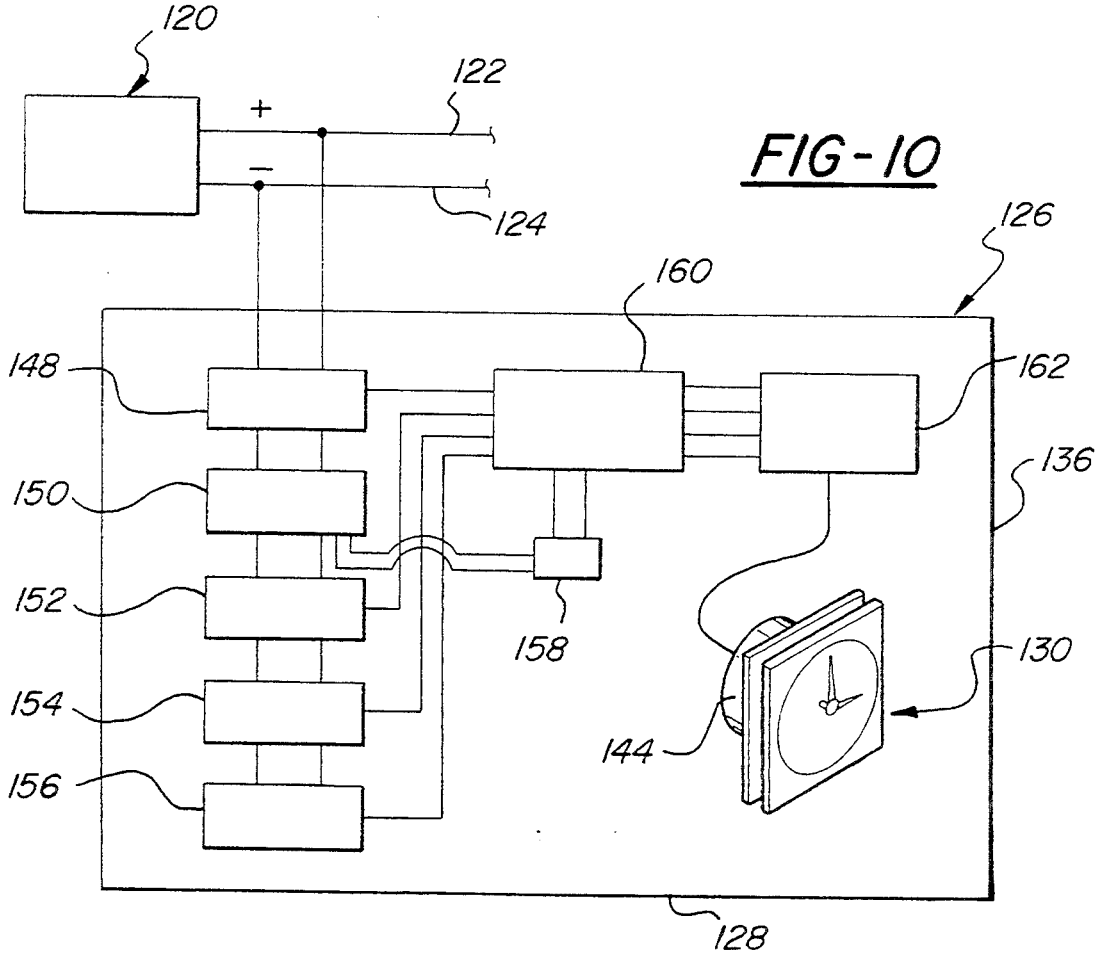
FIG. 10 is a block diagram of a control circuit for a secondary clock of the FIG. 9 embodiment.
Figure 11:
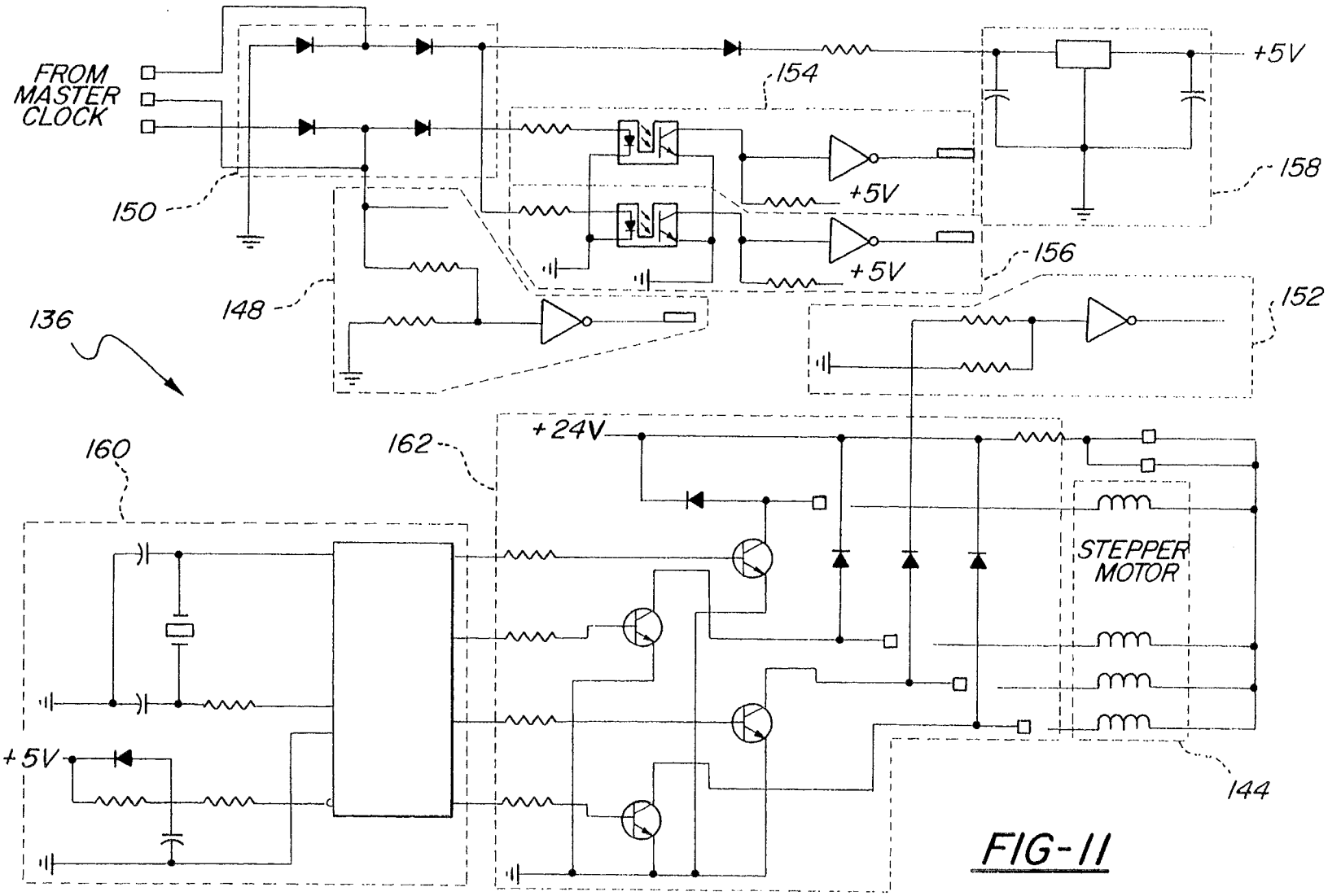
FIG. 11 is a circuit diagram of the control circuit for the secondary clock.

The invention clock system of the FIGS. 9–16 embodiment is similar in many respects to the FIGS. 1–8 embodiment and as such includes a master control unit 120, a pair of wires or leads 122 and 124, and a plurality of secondary clock assemblies 126 respectively connected in parallel to leads 122 and 124.

Each secondary clock assembly 126 includes a control assembly 128 and a secondary clock mechanism 130.

As best seen in FIGS. 12 and 13, each secondary clock mechanism 130 includes a rear plate 132, a front plate 134, a circuit board 136, an hour gear unit 138, a twelve hour gear unit 140, a reduction gear unit 142, a stepper motor 144, and spacers 146.

Front plate 134 includes spaced corner pillars **134*a* which pass through spacers 146 and through apertures in circuit board 136 to maintain the rear plate 132, circuit board 136, and front plate 134** in parallel spaced relation in the assembled condition of the clock.

Motor 144 is a single phase stepper motor and is mounted to the rear face **132*a* of backplate 132 with the output shaft 144*a* of the motor passing through an aperture in the rear plate to position output pinion shaft 144*b* between the rear plate and circuit board 136. Motor 22** is preferably a 24-volt DC two wire 7.5 degree stepper motor of the type available, for example, from Airpax, Inc. of Cheshire, Conn. as Part No. L 82401-P2.

Hour gear unit 138 includes an hour gear **138*a*, a pinion gear 138*b*, and a minute shaft 138*c*. Reduction gear unit 142 includes a reduction gear 142*a* and a pinion gear 142*b*. Twelve hour gear unit 140 includes a twelve hour gear 140*a* and an hour shaft 140*b***.

In the assembled relation of the clock components, pinion **144*a* drivingly engages hour gear 138*a*, pinion 138*c* drivingly engages reduction gear 142*a*, reduction gear pinion 142*b* drivingly engages twelve hour gear 142*b*, and minute shaft 138*c* is received concentrically within hour shaft 140*b* with both shafts extending forwardly to a position forwardly of front plate 134*a*** to provide the mounting for the minute and hour hands of the clock respectively.

It will be understood that the control assembly 128 of each secondary clock assembly 126 is actually physically located on the printed circuit board 136 of the secondary clock mechanism 130. Control assembly 128 includes a polarity detector 148, a rectifier 150, a pulse detector 152, an hour sensor 154, a twelve hour sensor 156, a five volt regulator 158, a microprocessor or other processing circuit 160, and a motor control circuit 162.

Hour sensor 154 is positioned on the rear face of the circuit board 136 and includes an infrared transmitter **154*a* and a receiver 154*b* coacting with a non-reflective strip 138*d* on the front face of hour gear 138*a* to either complete or disrupt a circuit between the transmitter and the receiver depending upon the presence or absence of the non-reflective strip 138*d*. Twelve hour sensor 156 is positioned on the front face of circuit board 136 and includes an infrared transmitter 156*a* and a receiver 156*b* coacting with a non-reflective strip 140*c* on the rear face of twelve hour gear 140*a* so as to either complete or disrupt a circuit between the transmitter and receiver depending upon the presence or absence of the non-reflective strip 140*c***.

It will be understood that the drive train of the clock places the minute hand in five-to-one driving relation to the output shaft of motor 144 and places the hour hand in a 12:1 ratio with respect to the minute hand so that the minute hand, in known clock fashion, moves at a rate 12 times the rate of the hour hand. It will further be understood that as the hour gear and the twelve hour gear rotate, the hour sensor and twelve hour sensors become selectively active and inactive depending upon the presence or absence of the non-reflective strips **138*d* and 140*c*** on the confronting faces of the hour gear and the twelve hour gear so as to enable the secondary clocks to move into registration on an hourly basis as well as on a twelve hour basis.

Master control unit 120 includes a master clock 164, a DC power supply 166, a polarity changer 168, a normal control line 170, a reset control line 172, and a battery 174.

Master clock 164 is computer based and is connected to a suitable 120 VAC source 174. The master clock tasks include time keeping, performing all calculations necessary to incrementally advance the second clocks to the exact time, transmitting all pulses on emitter normal line 122 or reset line 124, and interfacing with the user when programming automatic functions such as daylight savings and automatic actuation of peripheral devices such as bells, chimes, lights, etc. DC power supply 166 is also connected to 120-volt AC source 174 and serves to convert the 120 VAC source to 24 VDC for delivery over lines 176, 178 to polarity changer 168. Polarity changer 168 is connected between lines 176, 178 from DC power supply 102; lines 170,172 from master clock 164; and leads 122,124 connected to the secondary clocks.

Battery 174 is a backup power source and is connected by a lead 180 to master clock 164. Battery 174 is provided in the event of a power failure so that the master clock 164 can keep time without the AC power. Instead of a battery a receiver tuned to WBV or equivalent might be utilized.

The master unit keeps time by counting the cycles of the 120 VAC 60 Hz. power supplied by the local power company. The master unit can also be adapted to use a 50 Hz. supply. Other methods of time keeping can include receiving WWV, GPS or similar transmissions, modem connection with Bureau of Standards, or various oscillating crystal configurations. The master control unit transmits direct current pulses of voltages depending upon the stepper motor selection, in this example 24 volts DC. These pulses simultaneously advance each secondary clock in the system one increment. Specifically, during normal or real time operation, master clock 164 pulses normal line 170 which instructs the polarity changer 168 to send pulses over lines 122, 124 (with line 122 positive and 124 negative) once each minute for a duration of one second. These normal or real time pulses are received by the respective stepper motors 144 of the secondary clocks 126 and are operative to incrementally advance the respective clocks. As previously noted, the pulses are 24 VDC and each incremental advance moves the minute hand forward one minute.

The non-reflective surface **138*d* on hour gear 138 may, for example, include an angle 182 of approximately 18 degrees so that the non-reflective strip interrupts the communication between transmitter 154*a* and receiver 154*b* for approximately 3:00 minutes of each hour. The non-reflective surface 140*c* may, for example, include an angle 184 of approximately 20 degrees so that the non-reflective strip 140*c* is operative to interrupt the transmission of a signal between transmitter 156*a* and receiver 156*b*** for approximately 40:00 minutes of each 12 hour segment. The hour sensor is thus active once every hour beginning, for example, at xx:59 minutes and remains active, for example, for 3:00 minutes or until 2:00 minutes of the new hour and the 12 hour sensor is active once every 12 hours and will remain active for a span of 40 minutes beginning, for example, at 4:59 and ending at 5:39.

In the operation of the hour sensor, it will be understood that the secondary clocks are normally advanced by negative pulses from the master clock at one minute intervals and the negative pulses continue until a time of xx:59. If any given clock is already at xx:59, the hour sensor operates to prevent further advance. The master clock thereafter sends out a hour reset signal with the secondary clocks not already at xx:59 moving rapidly forwardly to xx:59. At xx:00:00, the master clock signals are changed to positive polarity signals which deactivate the sensors. The signals remain positive until four minutes after the hour, whereupon they revert to negative and reactivate the sensors.

In the operation of the 12 hour reset, a 12-hour reset signal is transmitted to the secondary clocks moving them rapidly forward to the pre-determined known registration time. At this time, the 12-hour sensors are active. All secondary clocks have now been synchronized.

The clock system has the ability at any time to move all of the secondary clocks to the correct time in response to a signal from the master clock. Specifically, the master clock has the capability of at any time transmitting a time data transmission 186, as seen in FIG. 16. The time data transmission 186 comprises a series of pulses from the master clock corresponding to a binary representation of hours and minutes. Specifically, ten bits of information are transmitted. The first four bits **186*a* correspond to a binary representation of the hours (1–12) and the remaining six bits 186*b* correspond to a binary representation of the minutes (0 through 59). The data pulses are positive polarity and are identified by a two second introductory or initiating pulse 186*c*. This introductory pulse distinguishes the time data transmission 180 from a regular minute pulse. The data bits are separated by 0.25 second breaks while the power to the processor is held by a capacitor. Additional 0.25 second pulses represent a zero bit and additional 0.5 second pulses represent a one bit. The time data transmission 186 is followed by a pulse 188** sufficient in length (e.g. 18 seconds) to allow enough time for the clocks to complete their movement to the real time as represented by the time data pulse.

The movement of the secondary clocks to the real time is accomplished by the secondary clock calculation of the movement required to display the time as indicated by the time data transmission.

Specifically, with reference to the time data transmission 186 shown in FIG. 17, the bit information encoded in the time data transmission 186 of FIG. 17 corresponds to a time of 10:34. When a secondary clock receives the 10:34 time data transmission shown in FIG. 17 during the 18 second pulse 188, the clock moves rapidly forward until the clock passes a known registration time, whereupon the hour and 12 hour sensors operate to inform the secondary clock microprocessor that it has passed a known registration time, whereupon the microprocessor performs a calculation to determine the differential between its known registration time and the known real time as encoded in the time data transmission, whereupon the secondary clock is thereafter moved by a pulse 188 from the master clock to the real time as represented by the encoded binary signal. The microprocessor of each secondary clock has the ability not only to calculate the time differential between its known registration time and the real time as encoded in the received time data transmission 186, but also has the ability to determine the shortest route form the registration time to the real time, i.e., clockwise or counterclockwise.

Note that the reset operation embodied in the FIGS. 9–16 embodiment differs from the reset operation embodied in the FIGS. 1–8 embodiment in the sense that in the FIGS. 1–8 embodiment, all of the secondary clocks must first be brought into registry at the registration time to ensure that all of the clocks are in fact at the same known registration time, whereas in the FIGS. 9–16 embodiment, because the microprocessor in each secondary clock provide intelligence at each secondary clock, the secondary clock upon passing its known registration time can move immediately to the real time without waiting for the other secondary clocks to be brought to the known registration time. The entire reset operation of the FIGS. 9–16 embodiment may be performed in less than 30 seconds.

It will be understood that the movement of the secondary clocks during normal time keeping is accomplished by a positive pulse of approximately 0.5 seconds from the master clock. Each secondary clock advances one minute for each pulse unless either or both of the hour and 12 hour sensors are active, in which caes the pulses must be negative polarity.

The invention master and secondary clock systems will be seen to provide many important advantages as compared to prior art systems. Specifically, the invention clock systems, while preserving the low power consumption feature of an impulse clock system, provide a simple, ready and effective means for resetting the secondary clocks at any time; provide a ready, simple and effective means of automatically correcting the secondary clocks in the event of a power interruption or a change of the time being kept by the master unit; and provide a sensing mechanism which, because of the use of a non-contact arrangement, avoids the contact wear and corrosion problems that have plagued prior art designs.

Although preferred embodiments of the invention have been illustrated and described in detail it will be apparent that various changes may be made in the disclosed embodiments without departing from the scope or spirit of the invention. For example, although impulse clock systems have been described in the examples given, the same technology and design can be utilized in an attendance recorder, a parking gate, a time stamp, or an elapsed time indicator system with appropriate modification of the drive mechanism and, for further example, although stepper motors have been described in the examples given, synchronous motor drives or other motor drives; i.e., DC servo, DC and AC non-synchronous, can also be used.

We claim:

1. A clock system including:

a plurality of analog secondary clocks each including motor means to advance the respective clock; and control means operative to maintain real time, generate real time pulses for transmittal to the motor means of the secondary clocks to advance the secondary clocks, and move the secondary clocks at any time, and irrespective of the instantaneous time differential between the secondary clocks, to the real time as determined by the control means.

2. A clock system according to claim 1 wherein:

the motor means comprise stepper motors.

3. A clock system including:

a plurality of analog secondary clocks each including motor means to advance the respective clock; and control means operative to maintain real time, generate real time pulses for transmittal to the motor means of the secondary clocks to advance the secondary clocks, and move the secondary clocks at any time to the real time as determined by the control means;

the control means including means operative to move the secondary clocks at a fast speed to a known time and means operative upon reaching the known time to calculate the differential between the known time and the real time and thereafter move the clocks to the real time.

4. A clock system according to claim 3 wherein the control means include:

a master clock operative to maintain real time and generate real time pulses for transmittal to the motor means of the secondary clocks; and means at each secondary clock operative to sense the arrival of the clock at the known time.

5. A clock system according to claim 4 wherein:

the master clock is further operative to generate encoded digital signals representing the real time as maintained by the master clock;

each secondary clock includes a processing circuit;

each secondary clock moves in response to receipt of an encoded digital signal from the master clock at a fast speed to the known time;

the processing circuit in the secondary clock is operative in response to the secondary clock reaching the known time to calculate the differential between the known time and the real time as represented by the encoded digital signal received by the processing circuit; and the secondary clock is thereafter moved at a fast speed to the real time as represented by the encoded digital signal.

6. A clock system according to claim 5 wherein:

each motor means comprises a stepper motor.

7. A clock system according to claim 4 wherein the master clock is further operative to generate a fast forward signal at any time to move the secondary clocks to the known time, is operative upon the arrival of the secondary clock at the known time to calculate the disparity between the known time and the real time, and is operative to thereafter move the secondary clocks to the real time at a fast forward speed.

8. A clock system according to claim 7 wherein each motor means is a stepper motor.

9. A clock system comprising:

a plurality of analog secondary clocks each including a motor device; and control means operative to maintain a master time, transmit real time pulses to said motors to advance the secondary clocks at real time, transmit fast forward signals to the motors to move the secondary clocks forwardly at a fast forward speed to a predetermined registration time, move the secondary clocks into registry upon their arrival at the registration time, and transmit fast forward signals to the motors to move the in-registry secondary clocks forwardly at a fast forward speed from the registration time to the master time.

10. A clock system according to claim 9 wherein:

the control means is operative to move the secondary clocks from the registration time to the master time by calculating the time discrepancy between the master time and the registration time and thereafter transmitting fast forward signals for a time sufficient to move the secondary clocks to the master time.

11. A clock system comprising:

a master clock unit operative to maintain real time, generate real time pulses, generate reset pulses, and generate encoded digital signals representing real time; and a plurality of analog secondary clocks receiving the real time pulses, reset pulses and the encoded digital signals, operative in response to receipt of the real time pulses to move incrementally forwardly, and operative in response to receipt of an encoded digital signal to move to the real time represented by the encoded digital signal.

12. A clock system comprising:

a master clock unit operative to maintain real time and generate real time pulses;

a plurality of analog secondary clocks receiving the real time pulses from the master clock and operative in response to receipt of the real time pulses to move incrementally forwardly; and means operative to move the secondary clocks at any time, and irrespective of the instantaneous time differential between the secondary clocks, to the real time as determined by the master clock.

13. A clock system including a master clock unit maintaining real time and a plurality of analog impulse secondary clocks maintained in synchronism by the master clock unit in response to real time pulses delivered to the secondary clocks by the master clock, characterized in that the system includes control means operative to move each of the secondary clocks at a fast speed to a known time, calculate the disparity between the known time and the real time, and move the clock at a fast speed to the real time.

14. A clock system including:

a master clock operative to keep a real master time and further operative to generate real time pulses;

a plurality of secondary analog clocks;

an incremental motor device associated with each secondary clock, arranged to receive the real time pulses from the master clock, and operative in response to receipt of the real time pulses to incrementally advance the respective secondary clock at real time speed;

means operative in response to a signal from the master clock to move each secondary clock at a fast speed to a known time;

means operative upon the arrival of the secondary clocks at the known time to calculate the disparity between the real time as determined by the master clock and the known time; and means operative to thereafter move each secondary clock at a fast speed to the real time based on the calculated disparity between the real time and the known time.

15. A clock system including:

a plurality of analog secondary clocks each including motor means to advance the respective clock; and control means operative to maintain real time, generate real time pulses for transmittal to the motor means of the secondary clocks to advance the secondary clocks, and move the secondary clocks at any time to the real time as determined by the control means;

the control means including a master clock operative to maintain real time, generate real time pulses, and generate encoded digital signals representing the real time as maintained by the master clock and a processing circuit at each secondary clock operative in response to receipt of an encoded digital signal from the master clock to move the respective secondary clock to the real time represented by the encoded digital signal.

* * * * *